United States Patent [19]

Nissen

[11] 3,979,843

[45] Sept. 14, 1976

[54] TRENCHING CHAIN WITH SCOOP MEMBERS

[75] Inventor: Roland Nielsen Nissen, Valley Center, Kans.

[73] Assignee: J. I. Case Company, Racine, Wis.

[22] Filed: Nov. 26, 1975

[21] Appl. No.: 635,654

[52] U.S. Cl. ..... 37/86; 83/832; 299/82; 299/84; 175/89; 37/DIG. 16; 37/191 A

[51] Int. Cl.[2] ..... E02F 5/06

[58] Field of Search ..... 37/69, 83–84, 37/86, 88, 191 A, 192 R, DIG. 16; 74/245 R; 198/189, 140, 151, 152; 83/830–834; 299/29, 82, 84; 175/89

[56] References Cited

UNITED STATES PATENTS

| | | | |
|---|---|---|---|
| 2,519,075 | 8/1950 | Schmidt | 37/86 |
| 2,589,015 | 3/1952 | Merz | 83/834 X |
| 2,708,798 | 5/1955 | Warner et al. | 37/86 |
| 3,050,881 | 8/1962 | Brown | 37/86 |
| 3,054,198 | 9/1962 | George et al. | 37/86 |
| 3,057,089 | 10/1962 | Kiechel et al. | 37/86 A |
| 3,846,922 | 11/1974 | Horton | 299/82 X |

FOREIGN PATENTS OR APPLICATIONS

| | | | |
|---|---|---|---|
| 1,030,987 | 5/1958 | Germany | 83/832 |

*Primary Examiner*—E. H. Eickholt
*Attorney, Agent, or Firm*—Arthur J. Hansmann

[57] ABSTRACT

A trenching chain arranged with links and pivot pins and with scoop members staggered laterally of the longitudinal direction of the chain and therealong. The scoop members have cup-shaped or curved scoop surfaces which are generally faced in the direction of movement of the chain for scooping earth or the like from the trench. Also, tooth picks or bars are mounted on the chain adjacent the scoop members and extend near the scoop surfaces and are articulated on the chain in a manner different from the movement or articulation of the scoop members themselves, and thus the picks clear the scoop members of dirt or the like when the chain is articulated or moved around a sprocket or the like.

7 Claims, 3 Drawing Figures

TRENCHING CHAIN WITH SCOOP MEMBERS

This invention relates to a trenching chain with scoop members and with scoop or tooth picks or bars which articulate with the scoop members, all for scooping dirt from a trench formed in the earth.

BACKGROUND OF THE INVENTION

The prior art is already aware of many different arrangements of trenching chains with digging members thereon, and isolated examples are found in U.S. Pat. Nos. 2,772,491 and 2,828,557 and 2,888,757. In the prior art, the digging tooth itself is generally arranged so that it loosens the dirt or material in which the trench is being formed, and the material is dragged out of the trench by means of the longitudinal movement of the chain with the digging members thereon. However, the chains of the prior art are not generally arranged for efficient movement of the dirt or like material from the trench, and the prior art is not aware of provision of chains which efficiently loosen the dirt and also remove it from the trench, all in one action or the continuous movement of the chain itself.

Accordingly, it is a primary object of this invention to improve upon trenching chains and to particularly provide a chain which has scoop teeth mounted thereon so that the teeth can both loosen the material and also remove it from the trench, all in one efficient and continuous motion of the chain. That is, the tooth design of this invention is such that it provides a scooping or dragging of the material from the trench, as well as loosening or cutting the material prior to removal from the trench.

Still further, the apparatus for trenching commonly employs a receiving auger which moves the material off to one side and thus permits efficient handling of the material dug out of the trench, and the present invention provides a staggering of the scoop or drag teeth which therefore efficiently distribute the dirt or material along the length of the auger which can therefore more easily and efficiently handle the continuous movement of the dirt to the auger.

Still further, the scoop or drag tooth of this invention is arranged to accomplish the aforementioned objectives and the tooth is formed with one curvature therein and thus is easily formed and fabricated and is of a sturdy construction and of a low cost, and the tooth of this invention can therefore be formed from rolled edge blade stock thus avoiding mill cut and thereby effecting the lower cost.

Still further, another important aspect of this invention is the provision of a trenching chain which has scoop or drag teeth mounted therealong and which has a tooth pick or bar which is mounted on the chain to articulate in a manner different from the articulation of the scoop tooth itself, such as when the chain is going around a sprocket or the like, and thus the tooth pick is provided for clearing the material from the scoop tooth and thus keep the chain free of clogging and capable of operating at full efficiency and capacity and to assure that the cut material will be dropped off the scoop tooth when the chain is moving around a sprocket to thereby create the relative movement between the scoop tooth and the tooth pick, as mentioned.

Still further, the present invention provides a trenching chain with a scoop or drag tooth having a scoop surface faced generally in the longitudinal direction of the chain and mounted on links of the chain but behind the location of the mounting link itself, all for providing an accelerated motion of the scoop tooth surface around the sprocket to flip the dirt out of the tooth.

Other objects and advantages will become apparent upon reading the following description in light of the accompanying drawings:

DETAILED DESCRIPTION OF THE PREFERRED EMBODIMENTS

Figure 1:
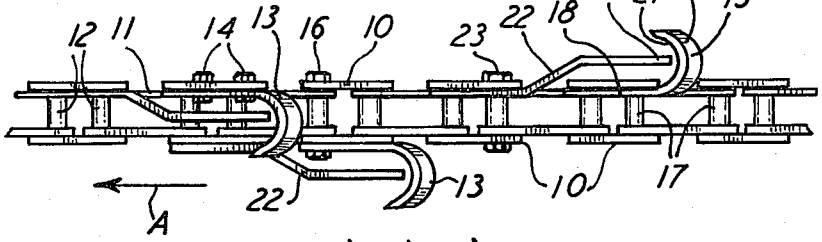
FIG. 1 is a top plan view of one arrangement of a trenching chain with scoop teeth and tooth picks thereon.

FIG. 1 shows a trenching chain which has a plurality of chain links 10, on the laterally outer sides of the chain, and an interconnecting plurality of chain links 11, on the laterally inside positions on the chain. Also, the usual plurality of pivot connectors 12 are suitably interposed between the links 10 and 11 to articularly and pivotally connect the links 10 and 11 in end-to-end relationship to form the endless chain, a fragment of which is shown in FIG. 1. It will be further understood, by anyone skilled in the art, that the links 10 are of a greater height than that of the links 11, and thus the links 10 extend upwardly and provide an attachment area for a plurality of scoop or drag teeth 13 which are suitably fastened to the links 10, such as by bolts or the like 14. Thus, the links 10 and 11 are connected together by the connectors 12, which includes the bolts 16 extending through the links 10 and 11 and through the usual spacer member 17, all as understood by anyone skilled in the art.

FIG. 1 further shows that the scoop or drag teeth members 13 are arranged with a shank portion 18 which is actually the portion connected with the upstanding links 10, and the scoop members 13 have the curved portions 19 which present scoop surfaces 21 faced in the direction of movement of the chain, as shown by the arrow designated A. Thus the scoop members 13 are staggered laterally of the chain and thereby provide a complete swath or kerf in the trenching action of using the chain for digging into the earth or the like. Also, by virtue of the presentation of the chain portion 19 and particularly the orientation and location of the scoop surfaces 21, the dirt can be dragged along by the chain as the chain is moved in its usual manner through the trench. Therefore, the scoop surface 21 is presented substantially in the full facing direction of the line of movement of the chain itself, to thereby provide a scooping or dragging action as well as a cutting action for the earth being worked upon.

Also, FIG. 1 shows that the chain has a plurality of bars in the form of tooth picks 22 which are also suitably mounted on the links 10, such as by bolts 23, and the bars 22 have extending ends 24 which terminate adjacent respective scoop surfaces 21. It should also be noticed that the arrangement of the pairs of scoop teeth 13 and tooth picks 22 are such that each member is mounted on different ones of links 10, namely adjacent links 10 to form the working pairs of members 13 and 22. With that arrangement, when the chain moves around a sprocket, as shown and described in connection with FIG. 3, then the tooth bar or pick 22 and the scoop member 13 will move relative to each other and thus the bar extending end 24 will move adjacent the scoop surface 21 to remove any dirt or the like thereon. Still further, the scoop tooth portion 19 is disposed rearwardly of the shank portion 18 and its mounting link 10 so that when the chain moves around a sprocket or the like there is an acceleration of the action of the scoop tooth portion 19 and thus the dirt is flipped or thrown off the scoop surface 21.

Figure 3:
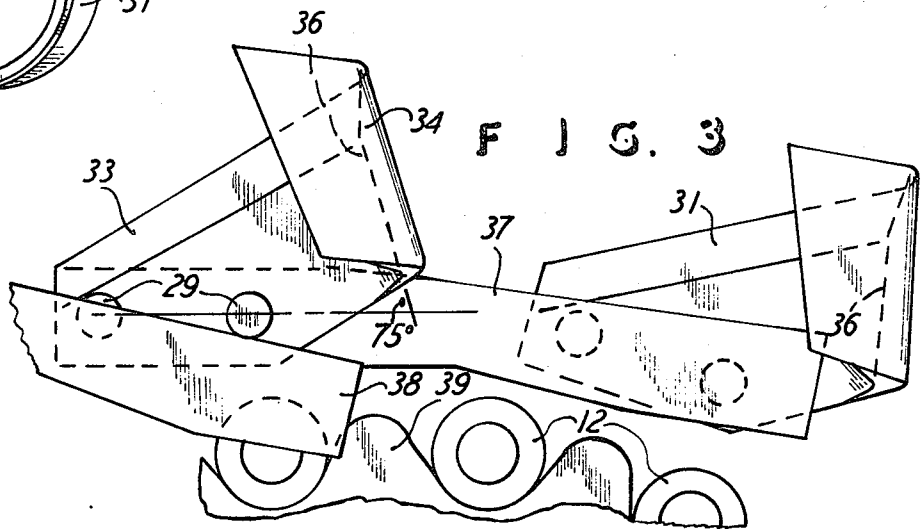
FIG. 3 is a side elevational view of a fragment of the chain shown in FIG. 2.

FIG. 1 therefore shows the arrangement of a trench chain having the scoop teeth 13 staggered laterally of the chain and also longitudinally thereon, and the scoop surface 21 is presented substantially forwardly of the motion of the chain to provide the scooping or dragging action for the tooth 13. It has been found that the orientation of the surface 21 relative to the forward or longitudinal direction of the chain itself is effectively located when there is at least a sixty degree angle of the surface 21 relative to that longitudinal direction of the chain. FIG. 3 shows the angle referred to, and it shows it to be actually 75°. Also it will be noticed that some of the scoop teeth 13 are disposed to curve laterally away from one side of the chain while others of the scoop teeth 13 are disposed to curve laterally away from the other side of the chain, and still other scoop teeth 13 are shown to be disposed to curve across the longitudinal plane of the chain, and these three arrangements are shown in the three teeth 13 seen in FIG. 1. Of course, correspondingly, the tooth picks 22 are arranged to be presented in sets or pairs with the respective scoop teeth 13, all for the purpose mentioned above. It will of course be understood by one skilled in the art that a general arrangement of a trenching chain and trenching machine are as shown in U.S. Pat. No. 2,828,557 and 2,888,757, and the chain of the present invention could be mounted on either of those machines.

Figure 2:
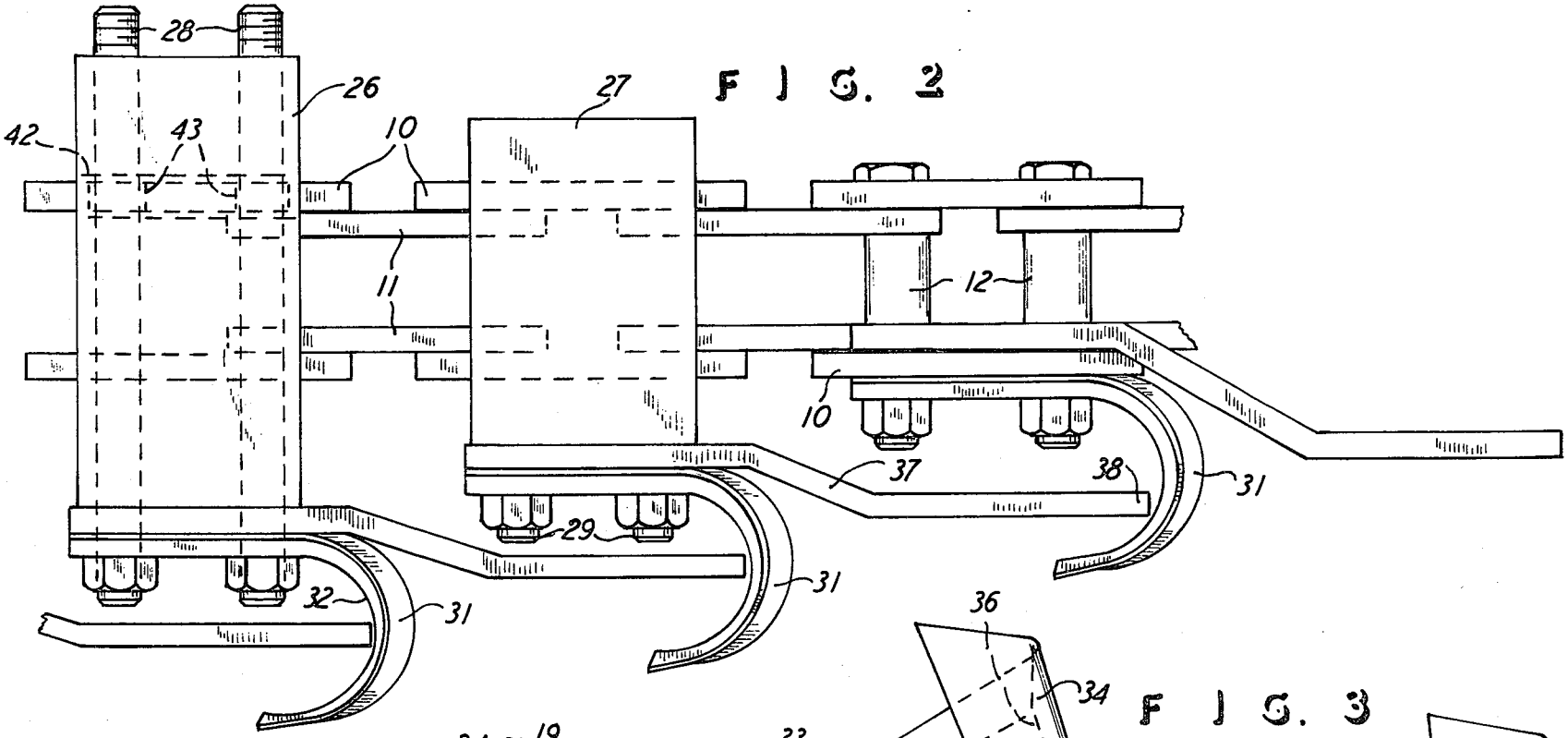
FIG. 2 is a top plan view of a trenching chain, similar to that of FIG. 1 but on an enlarged scale and with parts added thereto.

FIGS. 2 and 3 show the chain in a somewhat different form, and it will here be noticed that the upstanding links 10 have blocks 26 and 27 mounted thereon, and studs 28 and 29, respectively, extend through the blocks 26 and 27 for mounting scoop teeth 31 onto the chain. With that arrangement, the scoop teeth scoop surfaces 32 can be staggered laterally of the chain, as mentioned and as desired, and they can be disposed wider with respect to the longitudinal plane of the chain. Still further, the scoop tooth 31 on the right in FIG. 2 is shown mounted directly to the upstanding link 10, as in the FIG. 1 arrangement, and that also provides for the complete staggering and thereby complete tooth arrangement for forming the kerf in the earth. Therefore, as mentioned, the links 10 extend above the links 11 and the blocks 26 can be slotted with slots aligning with the links 10 and the respective bolts 28 and 29 can extend through the blocks 26 and 27 and through the respective links 10 for mounting the blocks on the chain and also the studs 28 and 29 can serve for securing the scoop teeth 31 to the sides of the blocks, as shown.

Again, and as seen in FIG. 3, the scoop teeth 31 have shank portions 33 which are aligned with and secured by the studs 29, for instance, and the scoop teeth portions 34 extend rearwardly of the shanks 33 and present their arcuately shaped portions 34 with the scoop surfaces 36 faced generally in the longitudinal direction of the chain, and FIG. 3 shows that facing angle to be seventy-five degrees.

FIGS. 2 and 3 also show the tooth pick 37 mounted in sets or pairs with the respective scoop teeth 31 such that the tooth pick 37 and the scoop tooth 31 are mounted on adjacent links 10 or with respect thereto, as shown and described.

It will therefore be seen and understood that when the chain moves over a sprocket, the scoop tooth portion 34 will be accelerated in its motion and tend to flip the dirt therefrom. Also, the tooth pick 37 will move relative to the scoop tooth 31 and it has its extending portion 38 adjacent the scoop tooth surface 36 to thereby clear the surface 36 of any dirt which may cling thereto. FIG. 3 shows a sprocket 39 and the chain rollers 12 related to the sprocket 39, and there would of course be at least one more sprocket for supporting the complete chain, all in a manner understood by one skilled in the art, and FIG. 3 shows the relative movement between the scoop tooth 31 and the tooth pick 37 when the chain is moving around a sprocket. It will also be understood that other teeth 31 may be mounted on the mounting blocks 26 and 27, in the arrangement shown in FIG. 1, and of course all of the scoop teeth 31 provide one continuous width of scooping surface across the chain and the teeth 31 would be arranged for the complete scooping function mentioned. Further, FIG. 2 shows the arrangement of the slots in the blocks 26 and 27, and one slot 42 is shown therein, and also it shows the arrangement of the holes in the links 10 through which the studs 27 and 28 can pass, and one hole 43 is thus shown in FIG. 2.

The movement of the chain about a sprocket or the like thus provides the articulation of the chain about its roller 17 or the like, and there is therefore the relative movement between the scoop teeth and the tooth picks which are arranged in pairs, as described, and there is also the accelerated motion for the scoop teeth when they move around the sprockets, by virtue of the offset of the arcuate portions of the respective scoop teeth and that offset being rearwardly relative to the forward direction of movement of the chain and with respect to the mounting or shank portion of the scoop tooth.

What is claimed is:

1. A trenching chain with scoop members comprising a plurality of chain links pivotally connected together for longitudinal movement in the direction of the length of the chain, a plurality of link pivot connectors extending between said links for pivotally connecting said links together in an endless chain arrangement, a plurality of scoop teeth included in the chain and each having a shank portion affixed relative to said links and having a scoop portion extending from said shank portion and being curved relative to said shank portion to have a scoop surface faced in the longitudinal direction of the length of the chain disposed along an angle of at least sixty degrees relative to the chain longitudinal direction for engaging and dragging earth in the movement of the chain, said scoop teeth being staggered in their positions along the chain and relative to the opposite sides of the chain, and a plurality of tooth picks attached to said chain at locations therealong different from the locations of said shank portion on said chain for pivoting relative to said scoop teeth in response to the articulation of said chain, said tooth picks each extending to a limit adjacent said scoop surface for brushing material off said scoop surface when said chain is articulated.

2. The trenching chain as claimed in claim 1, wherein some of said links extend in the direction away from said chain for a distance greater than does the remainder of said links, and said scoop teeth being affixed to said some of said links.

3. The trenching chain as claimed in claim 1, including mounting blocks affixed to said chain and extending laterally of said chain and beyond the side limits of said chain, said scoop teeth being mounted on the laterally extending sides of said mounting blocks to be disposed laterally of said chain.

4. The trenching chain as claimed in claim 1, wherein said scoop surface is a curved surface faced in the direction of chain movement.

5. The trenching chain as claimed in claim 1, wherein some of said links extend in the direction away from said chain for a distance greater than does the remainder of said links, and said scoop teeth being affixed to said some of said links.

6. The trenching chain as claimed in claim 1, including mounting blocks affixed to said chain and extending laterally of said chain and beyond the side limits of said chain, said scoop teeth being mounted on the laterally extending sides of said mounting blocks to be disposed laterally of said chain.

7. The trenching chain as claimed in claim 1, wherein said shank portions are respectively located on the respective planes of said pivot connectors, and said scoop portions respectively extend from said shank portions to locations behind said shank portions and off the respective planes of said pivot connectors relative to the longitudinal direction of the chain.

* * * * *